US012364340B2

(12) United States Patent
Liu et al.

(10) Patent No.: US 12,364,340 B2
(45) Date of Patent: Jul. 22, 2025

(54) INFLATABLE BED

(71) Applicant: BESTWAY INFLATABLES & MATERIAL CORP., Shanghai (CN)

(72) Inventors: Feng Liu, Shanghai (CN); Yihua You, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 18/077,400

(22) Filed: Dec. 8, 2022

(65) Prior Publication Data

US 2023/0122867 A1 Apr. 20, 2023

Related U.S. Application Data

(63) Continuation of application No. 16/907,893, filed on Jun. 22, 2020, now Pat. No. 11,564,505, which is a (Continued)

(30) Foreign Application Priority Data

Jan. 13, 2016 (CN) ..... 201610020533.5
Jan. 13, 2016 (CN) ..... 201620031074.6

(51) Int. Cl.
*A47C 27/08* (2006.01)
*A47C 27/16* (2006.01)

(52) U.S. Cl.
CPC ..... *A47C 27/081* (2013.01); *A47C 27/087* (2013.01); *A47C 27/16* (2013.01)

(58) Field of Classification Search
CPC ..... A47C 27/081; A47C 27/087
See application file for complete search history.

(56) References Cited

U.S. PATENT DOCUMENTS 2,360,715 A 10/1944 Hough
3,008,213 A * 11/1961 Foster ..... A47C 27/081 28/169

(Continued)

FOREIGN PATENT DOCUMENTS

CN 2706070 6/2005
CN 2904820 5/2007

(Continued)

OTHER PUBLICATIONS

Communication of a Notice of Opposition dated Jun. 27, 2019 (Jun. 27, 2019) on related European Patent Application 16191360.3 issued by the European Patent Office / Opposition Division.

(Continued)

*Primary Examiner* — Eric J Kurilla
(74) *Attorney, Agent, or Firm* — DICKINSON WRIGHT PLLC

(57) ABSTRACT

An inflatable bed is provided. The inflatable bed comprises a top sheet and a bottom sheet disposed vertically at an interval, at least one side wall, at least one first tensioning structure and at least one support structure. An upper edge of said side wall is coupled to an outer edge of said top sheet. A lower edge of said side wall is coupled to an outer edge of said bottom sheet. An upper end and a lower end of said first tensioning structure are respectively coupled to said top sheet and said bottom sheet. Said support structure is disposed in a longitudinal direction of at least one of said side walls. At least two outside edges of said support structure are respectively coupled to the side wall adjacent. At least one inside edge of said support structure is coupled to the top sheet or bottom sheet adjacent.

22 Claims, 16 Drawing Sheets

Related U.S. Application Data continuation of application No. 15/280,513, filed on Sep. 29, 2016, now Pat. No. 10,687,633.

(56) References Cited

U.S. PATENT DOCUMENTS

| | | | | |
|---|---|---|---|---|
| 4,541,135 | A | 9/1985 | Karpov | |
| 4,558,476 | A * | 12/1985 | Linder | A47C 27/085 5/687 |
| 4,941,223 | A | 7/1990 | Santo | |
| 5,669,091 | A | 9/1997 | Chung | |
| 6,568,013 | B2 | 5/2003 | Perez et al. | |
| 6,671,910 | B2 | 1/2004 | Hsu et al. | |
| 6,701,559 | B2 | 3/2004 | Boso et al. | |
| 6,754,926 | B2 | 6/2004 | Wang | |
| 6,971,134 | B2 | 12/2005 | Wu | |
| 6,996,867 | B2 | 2/2006 | Boso et al. | |
| 7,039,972 | B2 | 5/2006 | Chaffee | |
| 7,089,618 | B1 | 8/2006 | Metzger | |
| 7,165,283 | B2 | 1/2007 | Boso et al. | |
| 7,269,866 | B2 | 9/2007 | Liu | |
| 7,337,485 | B2 | 3/2008 | Metzger | |
| 7,346,950 | B2 | 3/2008 | Chung | |
| 7,530,128 | B2 | 5/2009 | Wu | |
| 8,562,773 | B2 | 10/2013 | Lin et al. | |
| 9,254,047 | B1 | 2/2016 | Schermel et al. | |
| 11,564,505 | B2 * | 1/2023 | Liu | A47C 27/16 |
| 2003/0101516 | A1 | 6/2003 | Hsu et al. | |
| 2005/0273938 | A1 | 12/2005 | Metzger et al. | |
| 2006/0265810 | A1 | 11/2006 | Wu | |
| 2007/0124864 | A1 * | 6/2007 | Lau | A47C 27/081 5/711 |
| 2007/0277324 | A1 | 12/2007 | Liu | |
| 2009/0165211 | A1 | 7/2009 | Rong-Jyh et al. | |
| 2013/0145660 | A1 | 6/2013 | Chen | |
| 2013/0228268 | A1 * | 9/2013 | Lin | B29C 66/439 156/166 |
| 2015/0147503 | A1 * | 5/2015 | Lin | B29C 66/0044 156/163 |
| 2015/0201760 | A1 * | 7/2015 | Lin | A47C 27/087 5/710 |
| 2015/0335164 | A1 * | 11/2015 | Liu | F24F 1/022 156/278 |
| 2017/0273472 | A1 * | 9/2017 | Liu | A47C 27/081 |
| 2019/0290013 | A1 * | 9/2019 | Boyd | A47C 27/083 |

FOREIGN PATENT DOCUMENTS

| | | | | |
|---|---|---|---|---|
| CN | 201045987 | | 4/2008 | |
| CN | 202751069 | | 2/2013 | |
| CN | 103110297 | | 5/2013 | |
| CN | 203137719 | | 8/2013 | |
| CN | 203137719 U | * | 8/2013 | A47C 27/087 |
| CN | 205457538 | | 8/2016 | |
| FR | 2914545 | | 10/2008 | |
| GB | 434098 | | 11/1933 | |
| JP | 1197403811 | | 6/1972 | |
| JP | 51-050166 | * | 3/1976 | A47C 27/08 |
| WO | 2013130117 | | 9/2013 | |

OTHER PUBLICATIONS

European Search Report dated May 11, 2017.
SIPO Search Report dated Jan. 30, 2019.
2014 Comfort Rest / Collection, 2013 Intex Marketing Ltd.

* cited by examiner

INFLATABLE BED

CROSS REFERENCE

The present application is continuation application of and claims priority to U.S. patent application Ser. No. 16/907,893, filed Jun. 22, 2020, which is a continuation application of and claims priority to U.S. patent application Ser. No. 15/280,513, filed Sep. 29, 2016, which claims the benefit and priority of Chinese Application No. 201610020533.5, filed Jan. 13, 2016 and Chinese Application No. 201620031074.6, filed Jan. 13, 2016. The entire disclosures of each of the above applications are incorporated herein by reference.

FIELD OF THE INVENTION

The present invention relates to inflatable beds or inflatable mattresses, and more specifically, to an inflatable bed, the structure of which is configured to limit the outward bulging or deformation of a side wall.

BACKGROUND

Currently, inflatable beds and inflatable mattresses have been very popular. The inflatable beds and inflatable mattresses have the advantages of light weight, easy to carry and store, etc., and thus are widely used in various occasions. For example, household inflatable beds and inflatable mattresses can often be used as temporary beds for visiting guests. In addition, the inflatable beds and inflatable mattresses are very suitable for use in outdoor camping.

Conventionally, the inflatable beds and inflatable mattresses are generally made of PVC sheet, PU sheet, or the like, and have various different structures, in which a typical mechanism is that using a top sheet, a bottom sheet, and a side wall coupled to the top sheet and the bottom sheet to form an inflatable air chamber. Tensioning structures, which are coupled to the top sheet and the bottom sheet and are arranged at an interval, are disposed in the air chamber, so as to form a shape having a certain height and a substantially flat upper surface for people to lie on.

Among the existing inflatable beds and inflatable mattresses, some have a larger height, whereby the side walls of the inflatable beds and inflatable mattresses after being inflated are susceptible to bulge and deform, affecting the appearance of the inflatable beds and inflatable mattresses. And, the bulging and deformation of the inflatable beds and inflatable mattresses may also result in the decay of air pressure in the air chamber, such that the inflatable beds and inflatable mattresses are softened, reducing the comfort of the inflatable beds and inflatable mattresses.

Therefore, in order to solve the above-mentioned problem of bulging of the side walls, in some inflatable beds and inflatable mattresses, a middle sheet is arranged between the top sheet and the bottom sheet and is coupled to the side walls. In the inflatable beds and inflatable mattresses of such a structure, although the problem of bulging and deformation of the side walls is slightly improved, the desired result still cannot be achieved. Moreover, since tensioning structures have to be arranged between the middle sheet and the top sheet and between the middle sheet and the bottom sheet, the manufacturing process of the inflatable beds and inflatable mattresses becomes more complicated, that is to say, more plastic sheet is required.

Furthermore, in the prior art, the inflatable beds and inflatable mattresses with a relatively large height have a defect in its stability. When a user lies on or seats near the edge of the inflatable beds and inflatable mattresses, the inflatable beds and inflatable mattresses are susceptible to roll over. In order to improve the stability, an inflatable stabilization tube is arranged on the outer periphery of the bottom sheet of the inflatable bed in U.S. Pat. No. 6,671,910. However, such a structure will not only affect the aesthetic appearance of the inflatable bed, but also brings inconvenience to the user.

SUMMARY

The technical problem to be solved by the present invention is to provide an inflatable bed, in order to overcome the defects of easy occurrence of bulging and deformation of the side walls of the inflatable beds and inflatable mattresses, poor stability of the inflatable beds and inflatable mattresses, and susceptibility of roll-over in the prior art.

The above-mentioned technical problems are solved according to the present invention by providing an inflatable bed, comprising a top sheet and a bottom sheet, which are disposed vertically at an interval, at least one side wall, at least one first tensioning structure, and at least one support structure.

An upper edge of said side wall is coupled to an outer edge of said top sheet. A lower edge of said side wall is coupled to an outer edge of said bottom sheet, and an air chamber is formed between said top sheet, said bottom sheet and said side wall.

The at least one first tensioning structure is arranged in said air chamber. An upper end and a lower end of said first tensioning structure are respectively coupled to said top sheet and said bottom sheet.

The at least one support structure is arranged in said air chamber. Said support structure is arranged in a longitudinal direction of at least one of said side walls. At least two outside edges of said support structure are respectively coupled to the side wall adjacent thereto, and at least one inside edge of said support structure is coupled to the top sheet or bottom sheet adjacent thereto.

Preferably, said support structure comprises a second tensioning structure and a third tensioning structure, at least two outside edges of said second tensioning structure are respectively coupled to the side wall adjacent thereto, and at least one inside edge of said second tensioning structure is coupled to the top sheet adjacent thereto.

The at least two outside edges of said third tensioning structure are respectively coupled to the side wall adjacent thereto, and at least one inside edge of said third tensioning structure is coupled to the bottom sheet adjacent thereto.

Preferably, said second tensioning structure and said third tensioning structure are respectively provided with a plurality of air holes, through which an airflow passage is formed in said air chamber.

Preferably, said second tensioning structure and said third tensioning structure are disposed at an interval in a perpendicular direction.

Preferably, said second tensioning structure comprises at least two first I-beams, an outside edge and an inside edge of each of said first I-beams, are respectively coupled to the side wall adjacent thereto and said top sheet, and the at least two first I-beams, are disposed at an interval.

Preferably, said third tensioning structure comprises at least two second I-beams, an outside edge and an inside edge of each of said second I-beams, are respectively coupled to the side wall adjacent thereto and said bottom sheet, and the at least two second I-beams, are disposed at an interval.

Preferably, said second tensioning structure comprises at least one first Y-beam, wherein two outside edges of said first Y-beam are respectively coupled to the side wall adjacent thereto, and an inside edge is coupled to said top sheet.

Preferably, said third tensioning structure comprises at least one second Y-beam, wherein two outside edges of said second Y-beam are respectively coupled to the side wall adjacent thereto, and an inside edge is coupled to said bottom sheet.

Preferably, said second tensioning structure comprises at least one first tubular beam, which has at least two outside edges respectively coupled to the side wall adjacent thereto, and at least one inside edge is coupled to said top sheet.

Preferably, said third tensioning structure comprises at least one second tubular beam, which has at least two outside edges respectively coupled to the side wall adjacent thereto, and at least one inside edge is coupled to said bottom sheet.

Preferably, said second tensioning structure comprises at least one first V-beam, wherein two outside edges of said first V-beam are respectively coupled to the side wall adjacent thereto, and an inside edge is coupled to said top sheet.

Preferably, said third tensioning structure comprises at least one second V-beam, wherein two outside edges of said second V-beam are respectively coupled to the side wall adjacent thereto, and an inside edge is coupled to said bottom sheet.

Preferably, said at least two first I-beams are arranged spaced apart from each other at a lower surface of said top sheet.

Preferably, said at least two second I-beams are arranged spaced apart from each other at an upper surface of said bottom sheet.

Preferably, said at least two first I-beams are arranged at an interval on an inner surface of said side wall in a perpendicular direction.

Preferably, said at least two second I-beams are arranged at an interval on the inner surface of said side wall in a perpendicular direction.

Preferably, the two outside edges of said at least one first Y-beam is arranged at an interval on an inner surface of said side wall in a perpendicular direction.

Preferably, the two outside edges of said at least one second Y-beam are arranged at an interval on the inner surface of said side wall in a perpendicular direction.

Preferably, said at least two outside edges of said at least one first tubular beam, which are coupled to the side wall adjacent thereto, are arranged at an interval on an inner surface of said side wall in a perpendicular direction.

Preferably, said at least two outside edges of said at least one second tubular beam, which are coupled to the side wall adjacent thereto, are arranged at an interval on the inner surface of said side wall in a perpendicular direction.

Preferably, the two outside edges of said at least one first V-beam is arranged at an interval on an inner surface of said side wall in a perpendicular direction.

Preferably, the two outside edges of said at least one second V-beam is arranged at an interval on an inner surface of said side wall in a perpendicular direction.

Preferably, said at least two first I-beams as a whole are of a continuous annular structure or a segmental annular structure.

Preferably, said at least two second I-beams as a whole are of a continuous annular structure or a segmental annular structure.

Preferably, said at least one first Y-bam as a whole is of a continuous annular structure or a segmental annular structure.

Preferably, said at least one second Y-beam as a whole is of a continuous annular structure or a segmental annular structure.

Preferably, said at least one first tubular beam as a whole is of a segmental annular structure.

Preferably, said at least one second tubular beam as a whole is of a segmental annular structure.

Preferably, said at least one first V-bream as a whole is of a continuous annular structure or a segmental annular structure.

Preferably, said at least one second V-beam as a whole is of a continuous annular structure or a segmental annular structure.

Preferably, said first tensioning structure is one or more beams selected from I-beams, coil beams, Y-beams or X-beams.

Preferably, said first tensioning structure, said second tensioning structure and said third tensioning structure are all made of thermoplastic plastic sheet.

Preferably, one or more of said first tensioning structure, said second tensioning structure and said third tensioning structure at least partially comprise mesh, laminated plastic sheet or a threads.

Preferably, two side surfaces of said mesh or said threads are at least partially coupled integrally with two opposite plastic strips, and said mesh and said threads are sandwiched between the two opposite plastic strips.

Preferably, two side surfaces of said mesh or said threads are at least partially coupled integrally with an U-shaped plastic strip, and said mesh and said threads are sandwiched between the U-shaped plastic strip.

Preferably, said first tensioning structure is coupled to said top and bottom sheets by means of high-frequency welding; said second tensioning structure is coupled to said top sheet and said side wall by means of high-frequency welding; and said third tensioning structure is coupled to said bottom sheet and said side wall by means of high-frequency welding.

Preferably, the height where said top sheet is located in the inside part of an upper edge of said second tensioning structure is lower than the height where said top sheet is located in the outside part of the upper edge of said second tensioning structure.

Preferably, the height where said bottom sheet is located in the inside part of a lower edge of said third tensioning structure is lower than the height where said bottom sheet is located in the outside part of the lower edge of said third tensioning structure.

Preferably, said inflatable bed further comprises a built-in air pump, which is arranged on said side wall and is located between a lower edge of said second tensioning structure and an upper edge of said third tensioning structure for inflating said air chamber.

Preferably, said inflatable bed further comprises an air valve, which is arranged on said side wall for the inflation and deflation of said inflatable bed.

The positive effects of the present invention lie in the following aspects.

The inflatable bed of the present invention overcomes the defect of outward bulging and deformation of the side walls of the inflatable beds and inflatable mattresses having a relatively large height in prior art, making their appearance more attractive. The inflatable beds and inflatable mattresses have a good stability, which overcomes the problem of susceptibility of roll-over in the prior art. Furthermore, the inflatable bed of the present invention can also prevent the user from rolling down during use.

BRIEF DESCRIPTION OF THE DRAWINGS

The above-mentioned and other features, properties and advantages of the present invention will become more apparent from the following description of embodiments with reference to the accompany drawings, in which.

DETAILED DESCRIPTION

The present invention will be further described below in conjunction with detailed embodiments and the accompanying drawings. More details are provided in the following detailed description in order for the present invention to be fully understood. However, the present invention can be implemented in various ways other than those described herein. A person skilled in the art can make similar analogy and modification according to the practical applications without departing from the spirit of the present invention, and therefore the contents of the detailed embodiments herein should not be construed as limiting to the scope of the present invention.

Embodiment 1

Figure 1:
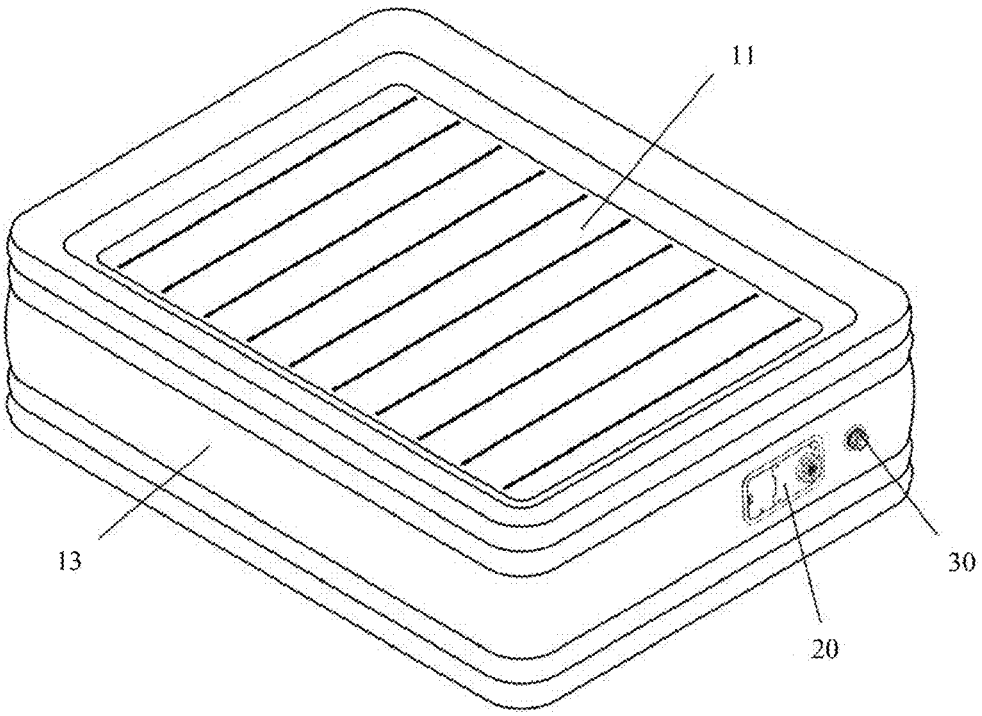
FIG. 1 is a perspective view of an inflatable bed according to the present invention.
Figure 2:
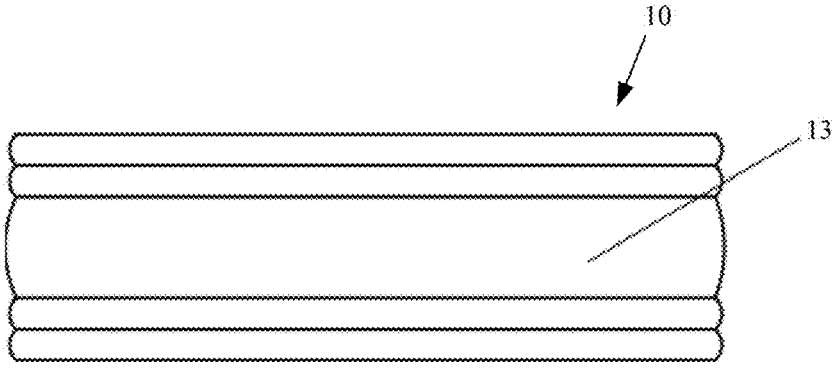
FIG. 2 is a front view of the inflatable bed according to the present invention.
Figure 3:
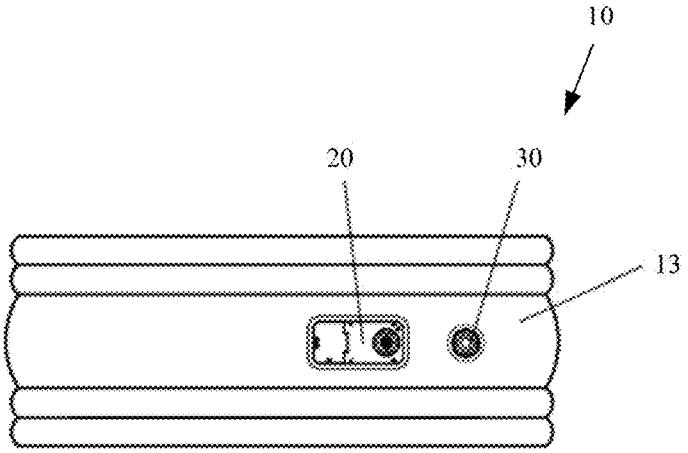
FIG. 3 is a right view of the inflatable bed according to the present invention.
Figure 4:
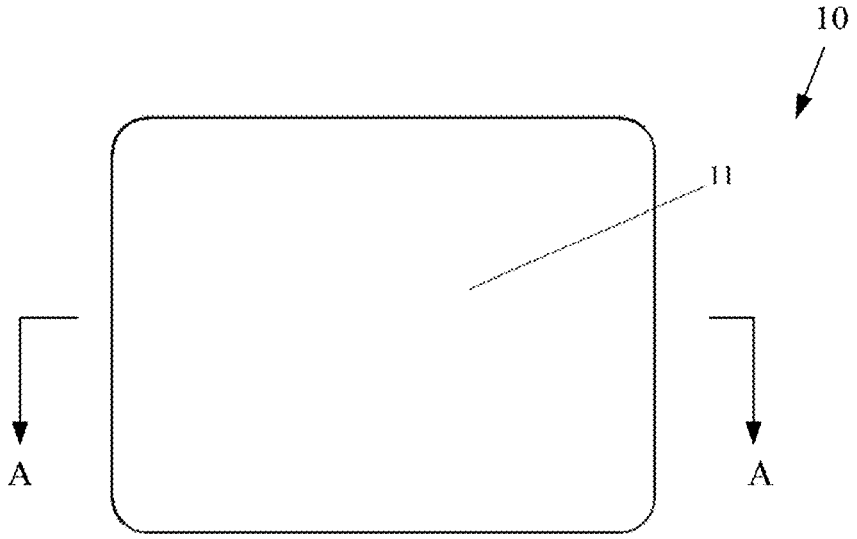
FIG. 4 is a top view of the inflatable bed according to the present invention.
Figure 5:
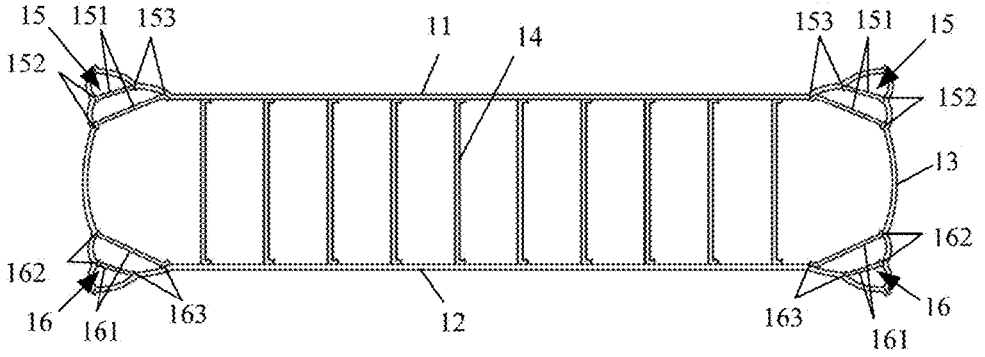
FIG. 5 is a sectional view of a first embodiment taken along line A-A in FIG. 4.
Figure 6:
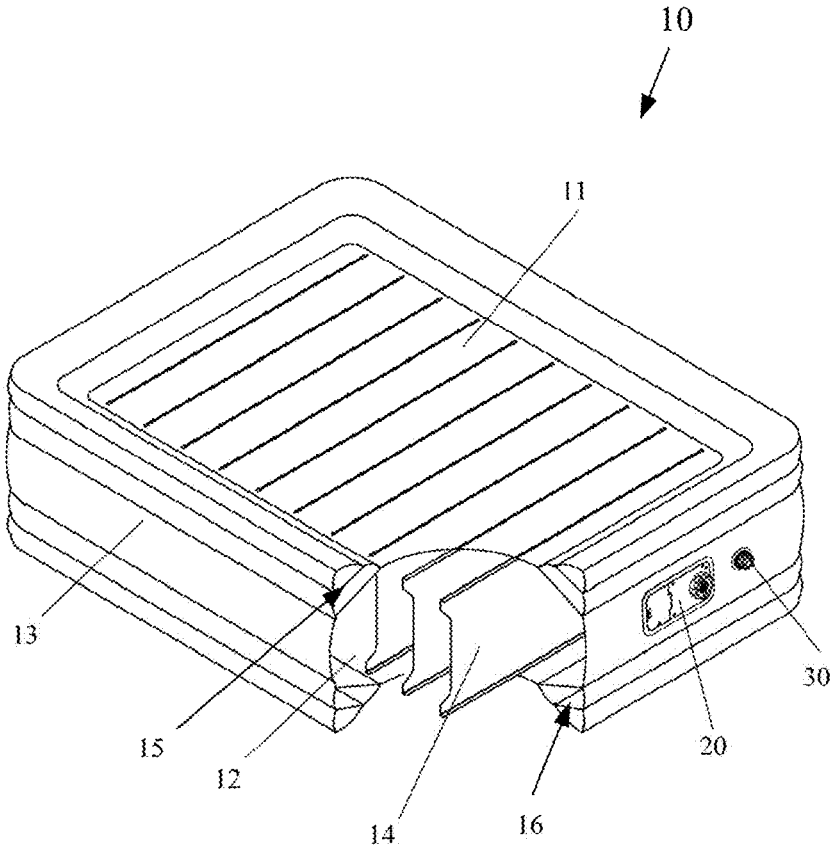
FIG. 6 is a schematic structural partially sectional view of the first embodiment of the inflatable bed according to the present invention.
Figure 7:
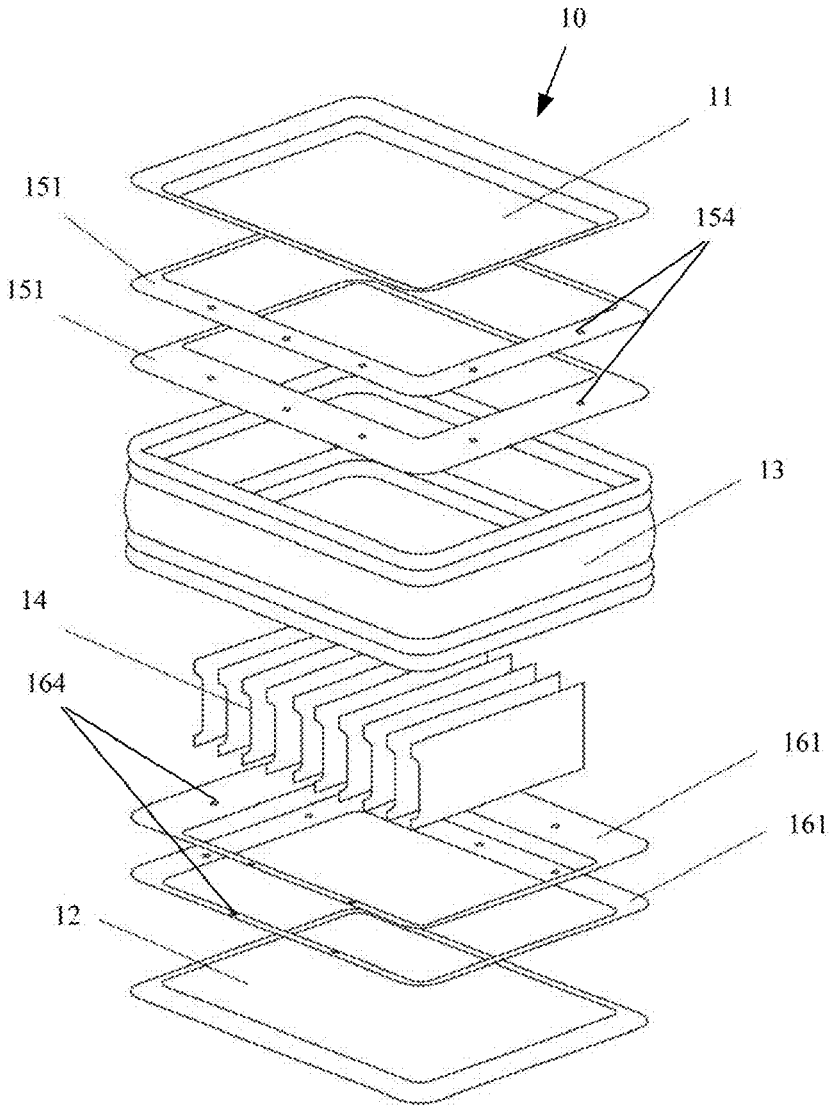
FIG. 7 is a first exploded view of the first embodiment of the inflatable bed according to the present invention.

FIG. 1 is a perspective view of an inflatable bed according to the present invention. FIG. 2 is a front view of the inflatable bed according to the present invention. FIG. 3 is a right view of the inflatable bed according to the present invention. FIG. 4 is a top view of the inflatable bed according to the present invention. FIG. 5 is a sectional view of a first embodiment taken along line A-A in FIG. 4. FIG. 6 is a schematic structural partially sectional view of the first embodiment of the inflatable bed according to the present invention. FIG. 7 is an exploded view of the first embodiment of the inflatable bed according to the present invention.

As shown in FIGS. 1-7, an inflatable bed 10 is disclosed in the first embodiment according to the present invention, which comprises a top sheet 11, a bottom sheet 12, at least one side wall 13, at least one first tensioning structure 14 and at least one support structure. The bottom sheet 12 and the top sheet 11 are disposed vertically at an interval, an upper edge of the side wall 13 is coupled to an outer edge of the top sheet 11, a lower edge of the side wall 13 is coupled to an outer edge of the bottom sheet 12, and an air chamber is formed between the top sheet 11, the bottom sheet 12 and the side wall 13. Moreover, the first tensioning structure 14 is arranged in the air chamber, and an upper end and a lower end of the first tensioning structure 14 are respectively coupled to the top sheet 11 and the bottom sheet 12. This has the effects of limiting the respective upward and downward bulging of the top sheet 11 and the bottom sheet 12 by means of the first tensioning structure 14 after said air chamber is inflated. In particular, both the top sheet 11 and the bottom sheet 12 may be configured as a two-layer structure, which can be formed with different patterns by mutually welding at least two sheets. Alternatively, a sponge structure is further sandwiched in the two-layer structure.

Said support structure is arranged in said air chamber herein, said support structure is arranged in the longitudinal direction of at least one of the side walls 13, at least two outside edges of said support structure are respectively coupled to the side wall 13 adjacent thereto, and at least one inside edge of said support structure is coupled to the top sheet 11 or bottom sheet 12 adjacent thereto.

Preferably, said support structure comprises a second tensioning structure 15 and a third tensioning structure 16. At least two outside edges of the second tensioning structure 15 are respectively coupled to the side wall 13 adjacent thereto, and at least one inside edge of the second tensioning structure is coupled to the top sheet 11 adjacent thereto. The second tensioning structure 15 is configured to limit the upward and lateral bulging of the top sheet 11 and the side wall 13 after said air chamber is inflated.

Moreover, at least two outside edges of the third tensioning structure 16 are respectively coupled to the side wall 13 adjacent thereto, and at least one inside edge of the third tensioning structure 16 is coupled to the adjacent bottom sheet 12. The third tensioning structure 16 is configured to limit the respective downward and lateral bulging of the bottom sheet 12 and the side wall 13 after said air chamber is inflated.

In this embodiment, the second tensioning structure 15 comprises at least two first I-beams 151, one outside edge 152 of each first I-beams 151 is coupled to the side wall 13 adjacent thereto, the other inside edge 153 is coupled to the top sheet 11 adjacent thereto, and the at least two first I-beams 151 are disposed at an interval. The third tensioning structure 16 comprises at least two second I-beams 161, one outside edge 162 of each second I-beam 161 is coupled to the side wall 13 adjacent thereto, the other inside edge 163 is coupled to the bottom sheet 12 adjacent thereto, and the at least two second I-beams 151 are disposed at an interval. In this embodiment, the numbers of first I-beams 151 and second I-beams 161 are both two by way of example, but their numbers are not limited by this embodiment, and may be more than two, which also fall within the scope of protection of the present invention.

The second tensioning structure 15 and the third tensioning structure 16 are preferably disposed at an interval in a perpendicular direction. In this embodiment, for example, the second tensioning structure 15 and the third tensioning structure 16 divide the respective side wall 13 into five sections, so that the second tensioning structure 15 is configured to limit the upward and lateral bulging of the top sheet 11 and the side wall 13 after said air chamber is inflated, and the third tensioning structure 16 is configured to limit the respective downward and lateral bulging of the bottom sheet 12 and the side wall 13 after said air chamber is inflated.

Of course, the second tensioning structure 15 and the third tensioning structure 16 may also divide the respective side wall 13 into a multi-section structure, such as a four- or six-section structure; this embodiment is merely exemplary and the present invention is not limited thereto, and all the structures with four or more sections fall within the scope of protection of the present invention.

Further, the at least two first I-beams 151 are arranged spaced apart from each other at a lower surface of the top sheet 11, and the at least two second I-beams 161 are arranged spaced apart from each other at an upper surface of the bottom sheet 12. The at least two first I-beams 151 are arranged at an interval on an inner surface of the side wall 13 in a perpendicular direction. The at least two second I-beams 161 are arranged at an interval on the inner surface of the side wall 13 in a perpendicular direction.

Figure 8:
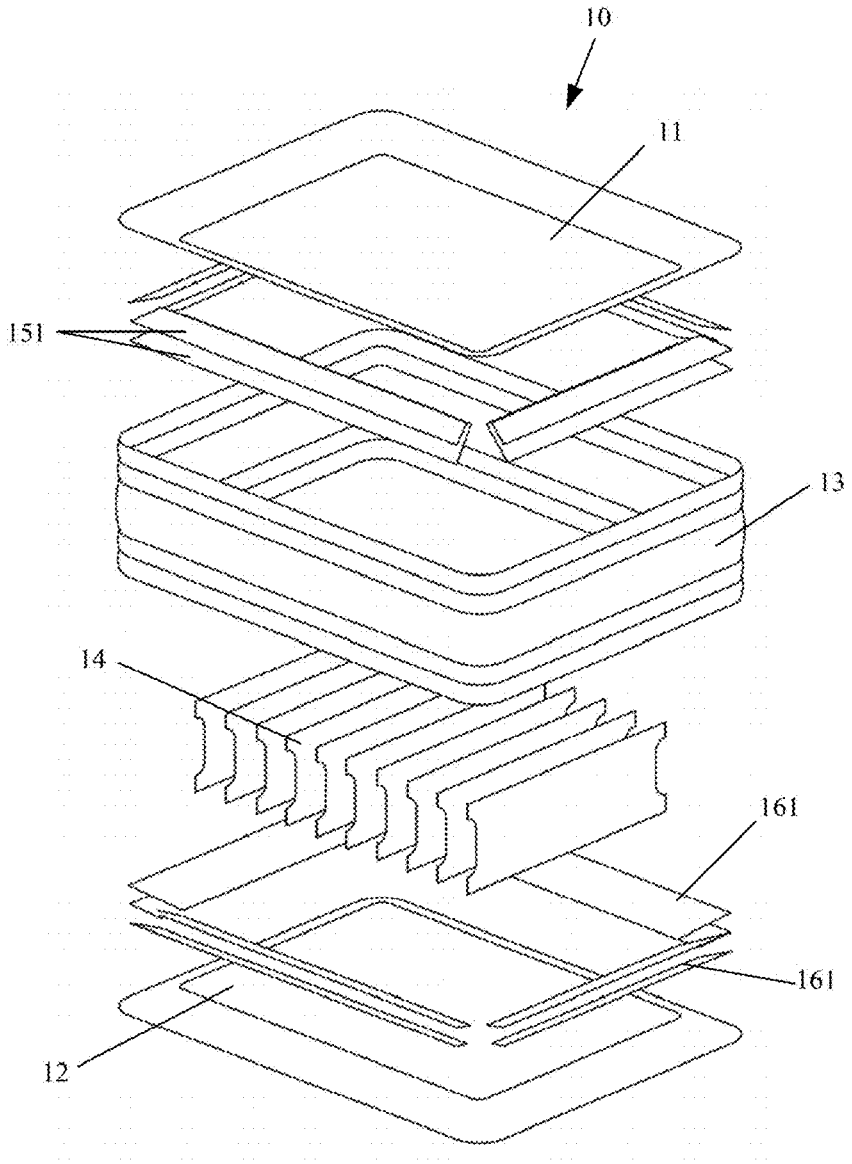
FIG. 8 is a second exploded view of the first embodiment of the inflatable bed according to the present invention.

Furthermore, the at least two first I-beams 151 as a whole are of a continuous annular structure or a segmental annular structure. The at least two second I-beams 161 as a whole are of a continuous annular structure or a segmental annular structure. Moreover, the at least two first I-beams 151 are provided with air holes 154, and an airflow passage is formed in said air chamber through the air holes 154. The at least two second I-beams 161 are provided with air holes 164, and an airflow passage is formed in said air chamber through the air holes 164 (as shown in FIGS. 7 and 8).

The first tensioning structure 14 of the present invention may employ one or more beams selected from I-beams, coil beams, Y-beams or X-beams. Moreover, the first tensioning structure 14, the second tensioning structure 15 and the third tensioning structure 16 may be all made of thermoplastic plastic sheet, and one or more of the first tensioning structure 14, the second tensioning structure 15 and the third tensioning structure 16 at least partially comprise mesh, laminated plastic sheet or threads.

The structures thereof may take various forms. For example, two side surfaces of said mesh or said threads are at least partially coupled integrally with two opposite s plastic strips, and said mesh and said threads are sandwiched between the two opposite plastic strips.

As another example, two side surfaces of said mesh for said threads are at least partially coupled integrally with an U-shaped plastic strip, and said mesh and said threads are sandwiched between the U-shaped plastic strip. These connecting structures can be used to effectively manufacture the beams required by the inflatable bed in the present invention; the solution in this embodiment is merely exemplary and the present invention is not limited thereto, and any other structure, which can implement the beam, falls within the scope of protection of the present invention.

On the basis of the structure of the above beams, in order to ensure a firm connection between the components, the first tensioning structure 14 is coupled to the top sheet 11 and the bottom sheet 12 by means of high-frequency welding. Similarly, the second tensioning structure 15 is coupled to the top sheet 11 and the side wall 13 by means of high-frequency welding. The third tensioning structure 16 is coupled to the bottom sheet 12 and the side wall 13 by means of high-frequency welding.

In the inflatable bed of the present invention formed of the aforementioned structure, the height where the top sheet 11 thereof is located in the inside part of an upper edge of the second tensioning structure 15 is lower than the height where the top sheet 11 is located in the outside part of the upper edge of the second tensioning structure 15. The height where the bottom sheet 12 is located in the inside part of a lower edge of the third tensioning structure 16 is lower than the height where the bottom sheet 12 is located in the outside part of the lower edge of the third tensioning structure 16.

Furthermore, the inflatable bed 10 further comprises a built-in air pump 20, and the built-in air pump 20 is arranged on the side wall 13 and is located between a lower edge of the second tensioning structure 15 and an upper edge of the third tensioning structure 16 for inflating said air chamber. Moreover, the inflatable bed 10 further comprises an air valve 30, and the air valve 30 is arranged on the side wall 13 for the inflation and deflation of the inflatable bed 10.

Embodiment 2

Figure 9:
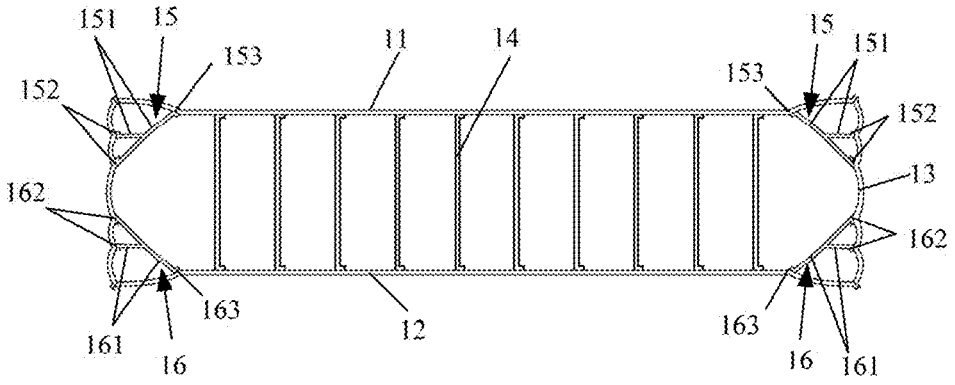
FIG. 9 is a sectional view of a second embodiment taken along line A-A in FIG. 4.
Figure 10:
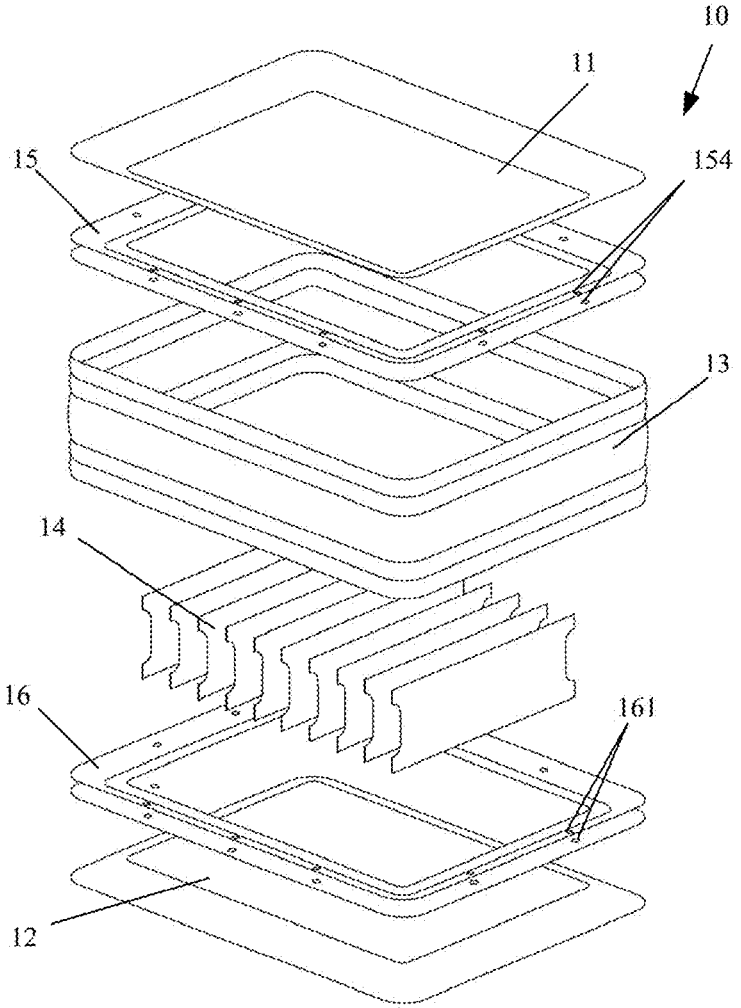
FIG. 10 is a first exploded view of the second embodiment of the inflatable bed according to the present invention.
Figure 11:
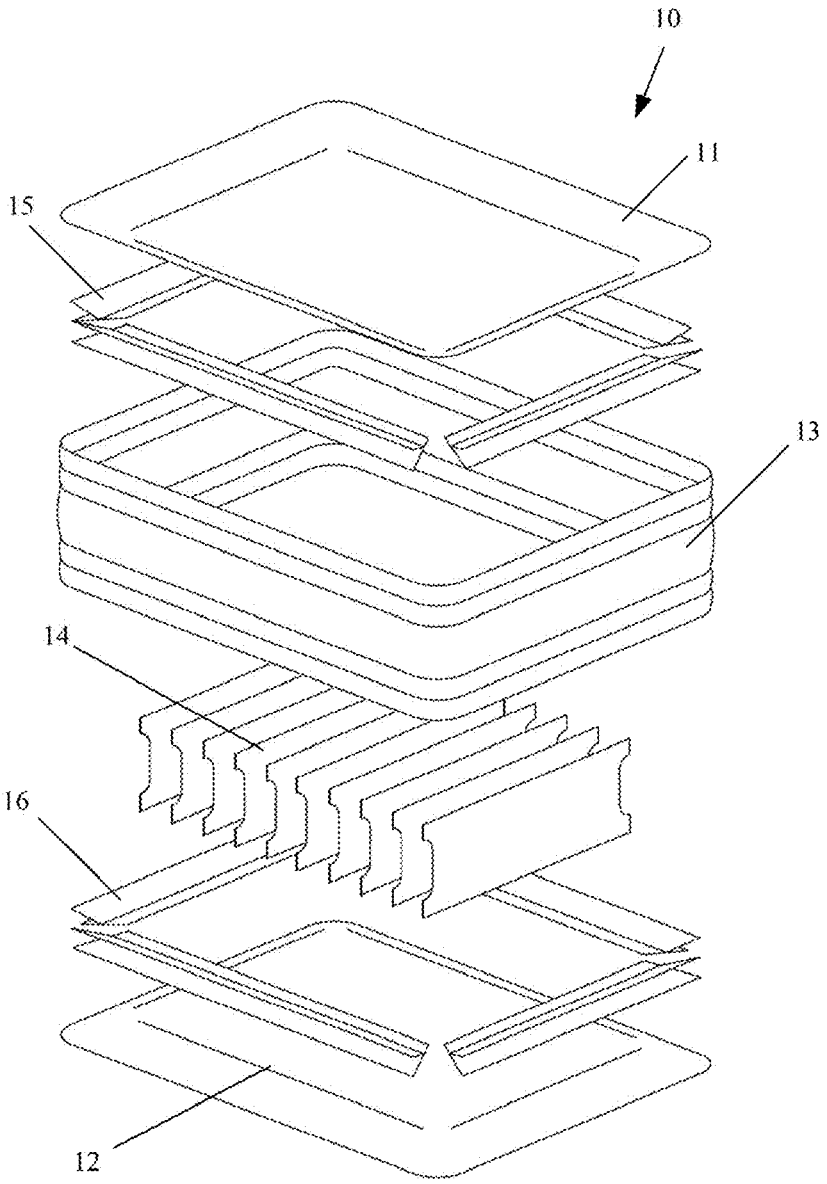
FIG. 11 is a second exploded view of the second embodiment of the inflatable bed according to the present invention.

FIG. 9 is a sectional view of a second embodiment taken along line A-A in FIG. 4. FIG. 10 is a first exploded view of the second embodiment of the inflatable bed of the present invention. FIG. 11 is a second exploded view of the second embodiment of the inflatable bed of the present invention.

As shown in FIGS. 9-11, the structure of this embodiment is substantially the same as that of the first embodiment, except that the second tensioning structure 15 comprises at least one first Y-beam 151, wherein two outside edges 152 of the first Y-beam 151 are respectively coupled to the side wall 13 adjacent thereto, and the other inside edge 153 is coupled to the top sheet 11. Similarly, the third tensioning structure 16 comprises at least one second Y-beam 161, wherein two outside edges 162 of the second Y-beam 161 are respectively coupled to the side wall 13 adjacent thereto, and the other inside edge 163 is coupled to the bottom sheet 12.

The second tensioning structure 15 and the third tensioning structure 16 are preferably disposed at an interval in a perpendicular direction. In this embodiment, the second tensioning structure 15 and the third tensioning structure 16 divide the respective side wall 13 into five sections, so that the second tensioning structure 15 is configured to limit the upward and lateral bulging of the top sheet 11 and the side wall 13 after said air chamber is inflated, and the third tensioning structure 16 is configured to limit the respective downward and lateral bulging of the bottom sheet 12 and the side wall 13 after said air chamber is inflated.

Of course, the second tensioning structure 15 and the third tensioning structure 16 may also divide the respective side wall 13 into a multi-section structure, such as a four- or six-section structure; this embodiment is merely exemplary and the present invention is not limited thereto, and all the structures with four or more sections fall within the scope of protection of the present invention.

Further, the two outside edges 152 of the at least one first Y-beam 151 are arranged at an interval on an inner surface of the side wall 13 in a perpendicular direction. The two outside edges 162 of the at least one second Y-beam 161 are arranged at an interval on the inner surface of the side wall 13 in a perpendicular direction.

Furthermore, the at least one first Y-beam 151 as a whole is of a continuous annular structure or a segmental annular structure. The at least one second Y-beam 161 as a whole is of a continuous annular structure or a segmental annular structure. Moreover, the at least one first Y-beam 151 is further provided with air holes 154, and an airflow passage is formed in said air chamber through the air holes 154. The at least one second Y-beam 161 is further provided with air holes 164, and an airflow passage is formed in said air chamber through the air holes 164 (as shown in FIGS. 10 and 11).

Embodiment 3

Figure 12:
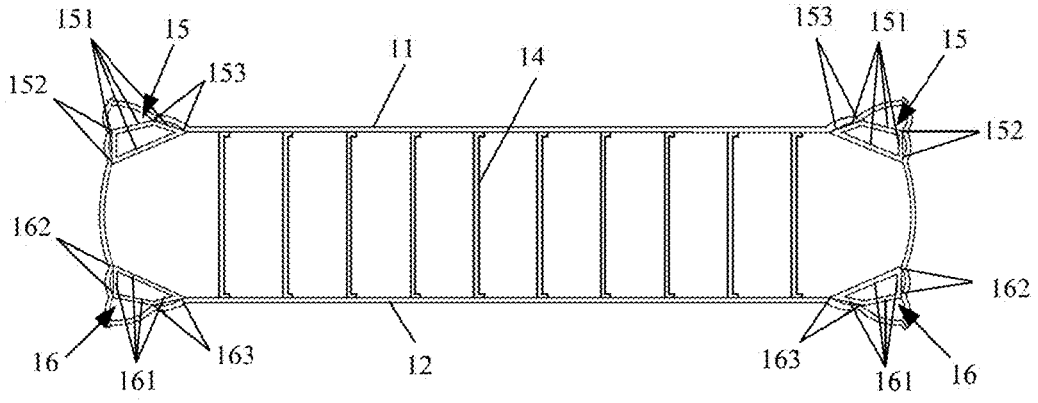
FIG. 12 is a first sectional view of a third embodiment taken along line A-A in FIG. 4.
Figure 13:
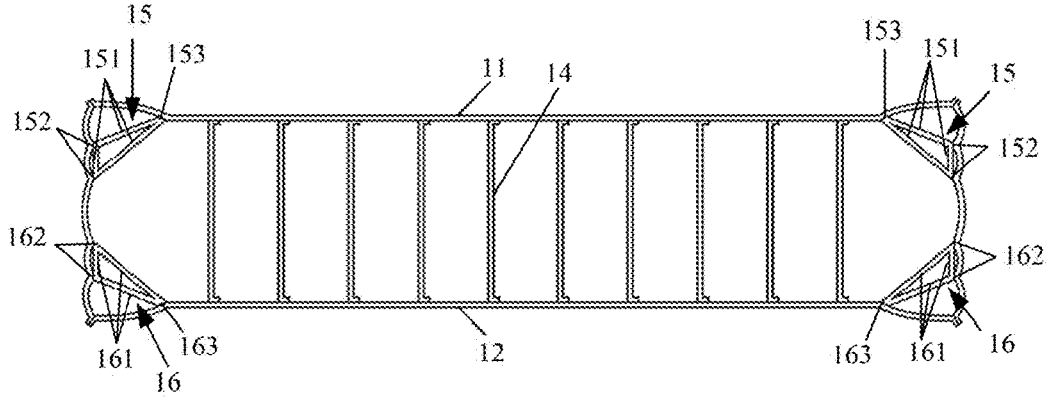
FIG. 13 is a second sectional view of the third embodiment taken along line A-A in FIG. 4.
Figure 14:
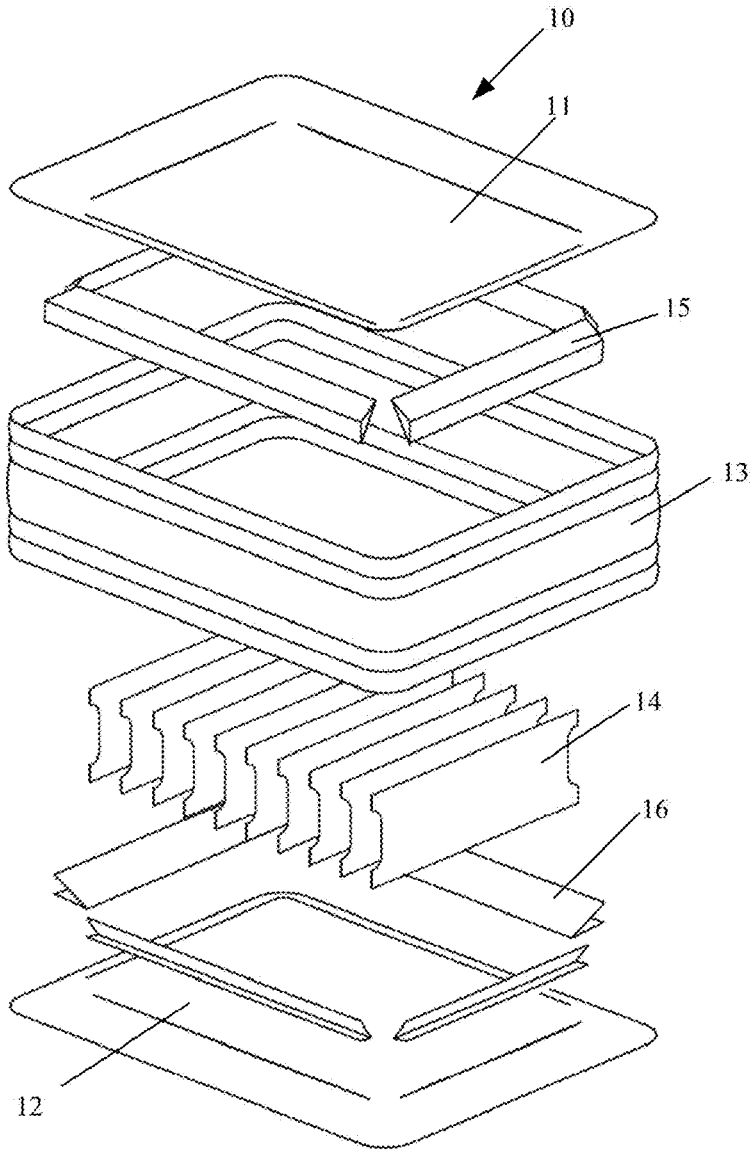
FIG. 14 is a first exploded view of the third embodiment of the inflatable bed according to the present invention.
Figure 15:
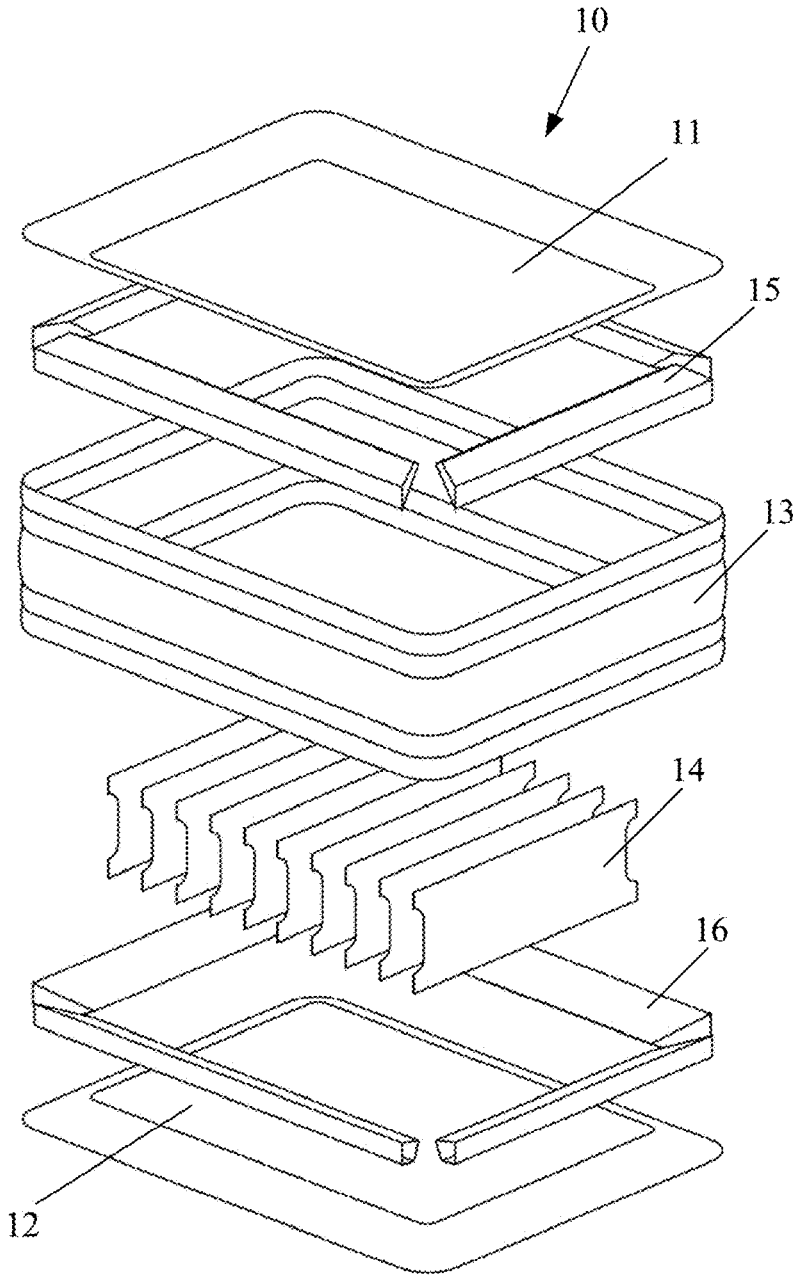
FIG. 15 is a second exploded view of the third embodiment of the inflatable bed according to the present invention.

FIG. 12 is a first sectional view of a third embodiment taken along line A-A in FIG. 4. FIG. 13 is a second sectional view of the third embodiment taken along line A-A in FIG. 4. FIG. 14 is a first exploded view of the third embodiment of the inflatable bed of the present invention. FIG. 15 is a second exploded view of the third embodiment of the inflatable bed of the present invention.

As shown in FIGS. 12-15, the structure of this embodiment is substantially the same as that of the first embodiment, except that the second tensioning structure 15 comprises at least one first tubular beam 151, wherein the first tubular beam 151 has at least two outside edges 152 respectively coupled to the side wall 13 adjacent thereto, and at least one inside edge 153 is coupled to the top sheet 11. The third tensioning structure 16 comprises at least one second tubular beam 161, wherein the second tubular beam 161 has at least two outside edges 162 respectively coupled to the side wall 13 adjacent thereto, and at least one inside edge 163 is coupled to the bottom sheet 12. The first tubular beam 151 and the second tubular beam 161 herein may be of various tubular structures, such as a triangular tubular structure, or a quadrilateral tubular structure (as shown in FIGS. 13 and 14).

Beam 151, which are coupled to the wall 13 adjacent thereto, are arranged at an interval on an inner surface of the side wall 13 in a perpendicular direction. The at least two outside edges 162 of the at least one second tubular beam 161, which are coupled to the wall 13 adjacent thereto, are arranged at an interval on an inner surface of the side wall 13 in a perpendicular direction.

The at least one first tubular beam 151 herein as a whole is of a segmental annular structure. The at least one second tubular beam 161 as a whole is of a segmental annular structure (as shown in FIGS. 13 and 14).

The second tensioning structure 15 and the third tensioning structure 16 are preferably disposed at an interval in a perpendicular direction. In this embodiment, the second tensioning structure 15 and the third tensioning structure 16 divide the respective side wall 13 into five sections, so that the second tensioning structure 15 is configured to limit the upward and lateral bulging of the top sheet 11 and the side wall 13 after said air chamber is inflated, and the third tensioning structure 16 is configured to limit the respective downward and lateral bulging of the bottom sheet 12 and the side wall 13 after said air chamber is inflated.

Of course, the second tensioning structure 15 and the third tensioning structure 16 may also divide the respective side wall 13 into a multi-section structure, such as a four- or six-section structure; this embodiment is merely exemplary and the present invention is not limited thereto, and all the structures with four or more sections fall within the scope of protection of the present invention.

Embodiment 4

Figure 16:
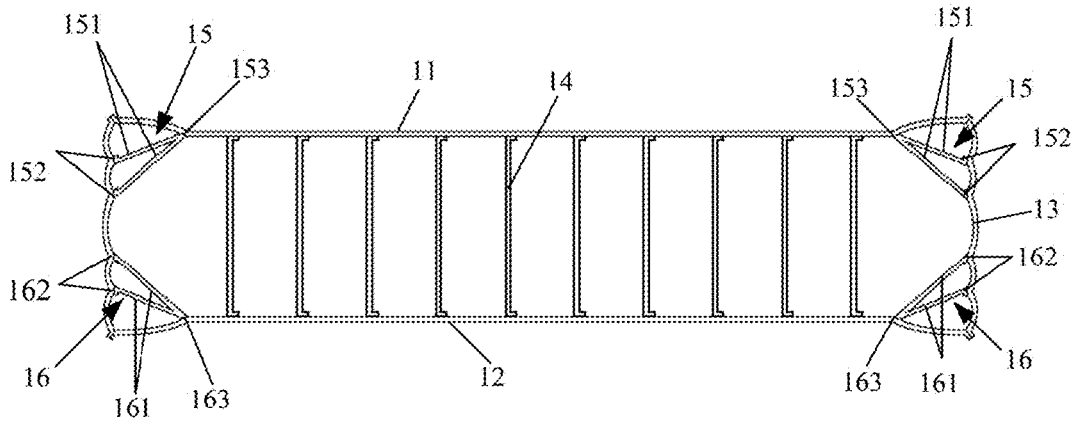
FIG. 16 is a sectional view of a fourth embodiment taken along line A-A in FIG. 4.
Figure 17:
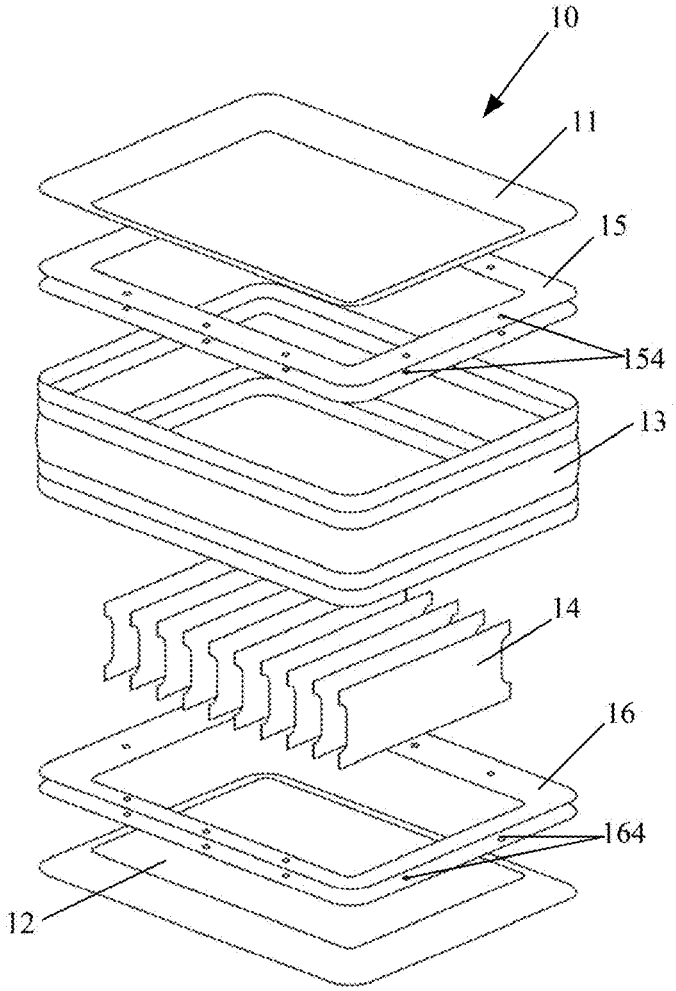
FIG. 17 is a first exploded view of the fourth embodiment of the inflatable bed according to the present invention.
Figure 18:
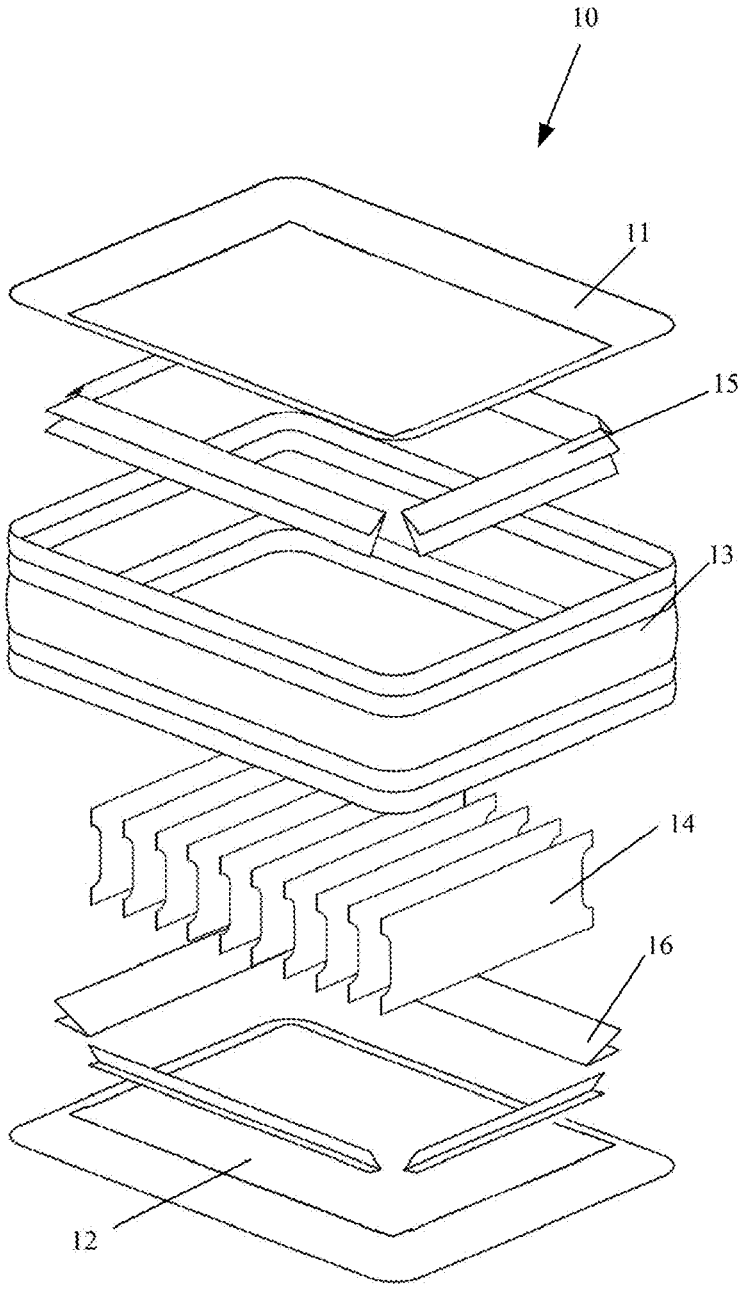
FIG. 18 is a second exploded view of the fourth embodiment of the inflatable bed according to the present invention.

FIG. 16 is a sectional view of a fourth embodiment taken along line A-A in FIG. 4. FIG. 17 is a first exploded view of the fourth embodiment of the inflatable bed of the present invention. FIG. 18 is a second exploded view of the fourth embodiment of the inflatable bed of the present invention.

As shown in FIGS. 16-18, the structure of this embodiment is substantially the same as that of the first embodiment, except that the second tensioning structure 15 comprises at least one first V-beam 151, wherein two outside edges 152 of the first V-beam 151 are respectively coupled to the side wall 13 adjacent thereto, and the other inside edge 153 is coupled to the top sheet 11. The third tensioning structure 16 comprises at least one second V-beam 161, wherein two outside edges 162 of the second V-beam 161 are respectively coupled to the side wall 13 adjacent thereto, and the other inside edge 163 is coupled to the top sheet 11.

Further, the two outside edges 152 of the at least one first V-beam 151 are arranged at an interval on an inner surface of the side wall 13 in a perpendicular direction. The two outside edges 162 of the at least one second VV-beam 161 are arranged at an interval on the inner surface of the side wall 13 in a perpendicular direction.

Furthermore, the at least one first V-beam 151 as a whole is of a continuous annular structure or a segmental annular structure. The at least one second V-beam 161 as a whole is of a continuous annular structure or a segmental annular structure. Moreover, the at least one first V-beam 151 is provided with air holes 154, and an airflow passage is formed in said air chamber through the air holes 154. The at least one second V-shaped drawstring V-beam 161 is provided with air holes 164, and an airflow passage is formed in said air chamber through the air holes 164.

The second tensioning structure 15 and the third tensioning structure 16 are preferably disposed at an interval in a perpendicular direction. In this embodiment, the second tensioning structure 15 and the third tensioning structure 16 divide the respective side wall 13 into five sections, so that the second tensioning structure 15 is configured to limit the upward and lateral bulging of the top sheet 11 and the side wall 13 after said air chamber is inflated, and the third tensioning structure 16 is configured to limit the respective downward and lateral bulging of the bottom sheet 12 and the side wall 13 after said air chamber is inflated.

Of course, the second tensioning structure 15 and the third tensioning structure 16 may also divide the respective side wall 13 into a multi-section structure, such as a four- or six-section structure; this embodiment is merely exemplary and the present invention is not limited thereto, and all the structures with four or more sections fall within the scope of protection of the present invention.

Embodiment 5

Figure 19:
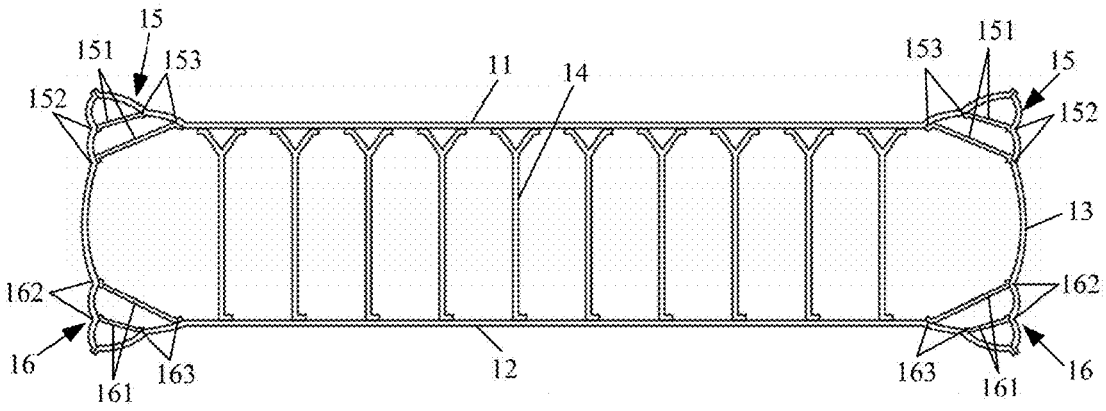
FIG. 19 is a sectional view of a fifth embodiment taken along line A-A in FIG. 4.
Figure 20:
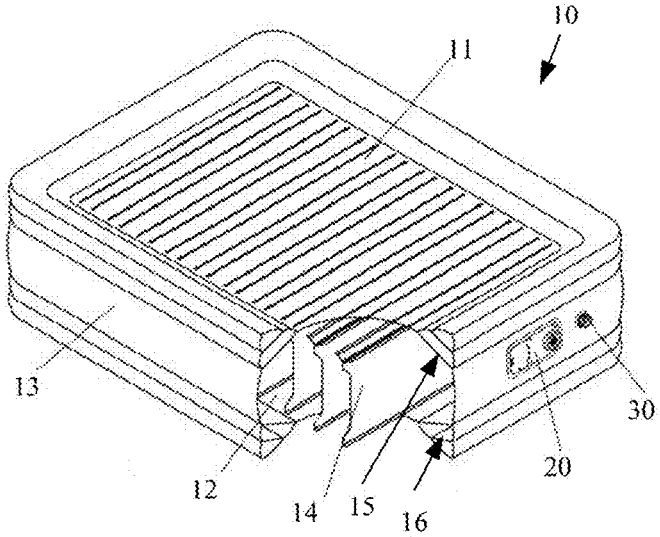
FIG. 20 is a schematic structural partially sectional view of the fifth embodiment of the inflatable bed according to the present invention.

FIG. 19 is a sectional view of a fifth embodiment taken along line A-A in FIG. 4. FIG. 20 is a schematic structural partially sectional view of the fifth embodiment of the inflatable bed of the present invention.

As shown in FIGS. 19 and 20, the structure of this embodiment is substantially the same as that of the first embodiment, except that the first tensioning structure 14 employs a Y-beam, and the upper and lower ends of the first tensioning structure 14 are respectively coupled to the top sheet 11 and the bottom sheet 12. Several beams in the first tensioning structure 14 are arranged spaced apart from each other. The upper end of each beam of the first tensioning structure 14 takes the form of a fork and is coupled to and supports the top sheet 11, and the lower end takes the form of an I-beam and is downwardly coupled to the bottom sheet 12. After said air chamber is inflated, such a structure can effectively limit the respective upward and downward bulging of the top sheet 11 and the bottom sheet 12.

Embodiment 6

Figure 21:
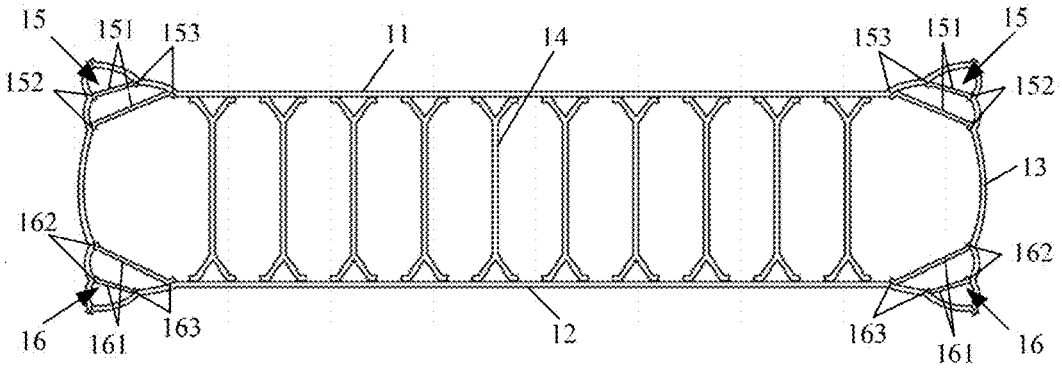
FIG. 21 is a sectional view of a sixth embodiment taken along line A-A in FIG. 4.

FIG. 21 is a sectional view of a sixth embodiment taken along line A-A in FIG. 4.

As shown in FIG. 21, the structure of this embodiment is substantially the same as that of the fifth embodiment, except that the first tensioning structure 14 employs an X-shaped drawstring at the upper and lower ends, and the upper and lower ends of the first tensioning structure 14 are respectively coupled to the top sheet 11 and the bottom sheet 12. Several drawstrings in the first tensioning structure 14 are arranged spaced apart from each other. The upper end of each drawstring of the first tensioning structure 14 takes the form of a folk and is upwardly coupled to the top sheet 11, and the lower end also takes the form of a folk and is downwardly coupled to the bottom sheet 12. After said air chamber is inflated, such a structure can limit the respective upward and downward bulging of the top sheet 11 and the bottom sheet 12 more effectively.

Embodiment 7

Figure 22:
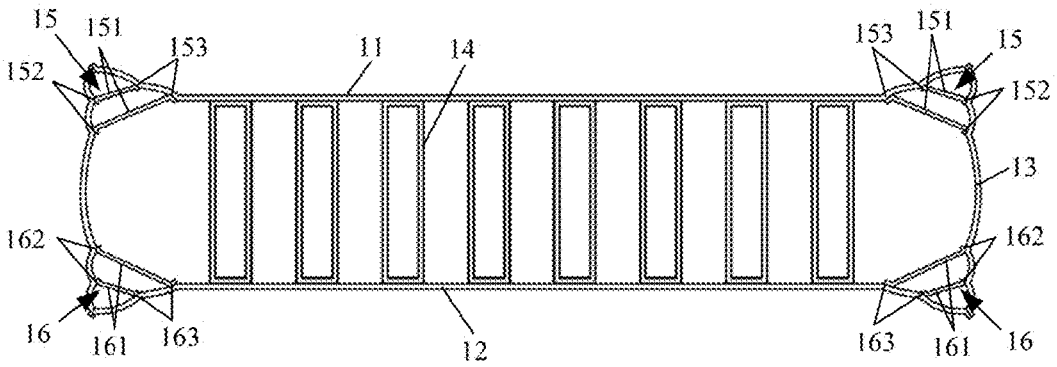
FIG. 22 is a sectional view of a seventh embodiment taken along line A-A in FIG. 4.
Figure 23:
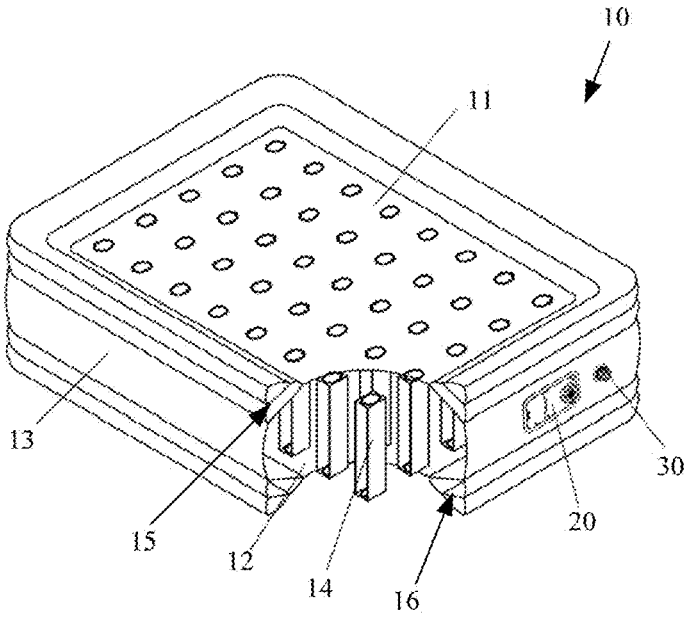
FIG. 23 is a schematic structural partially sectional view of the seventh embodiment of the inflatable bed according to the present invention.
Figure 24:
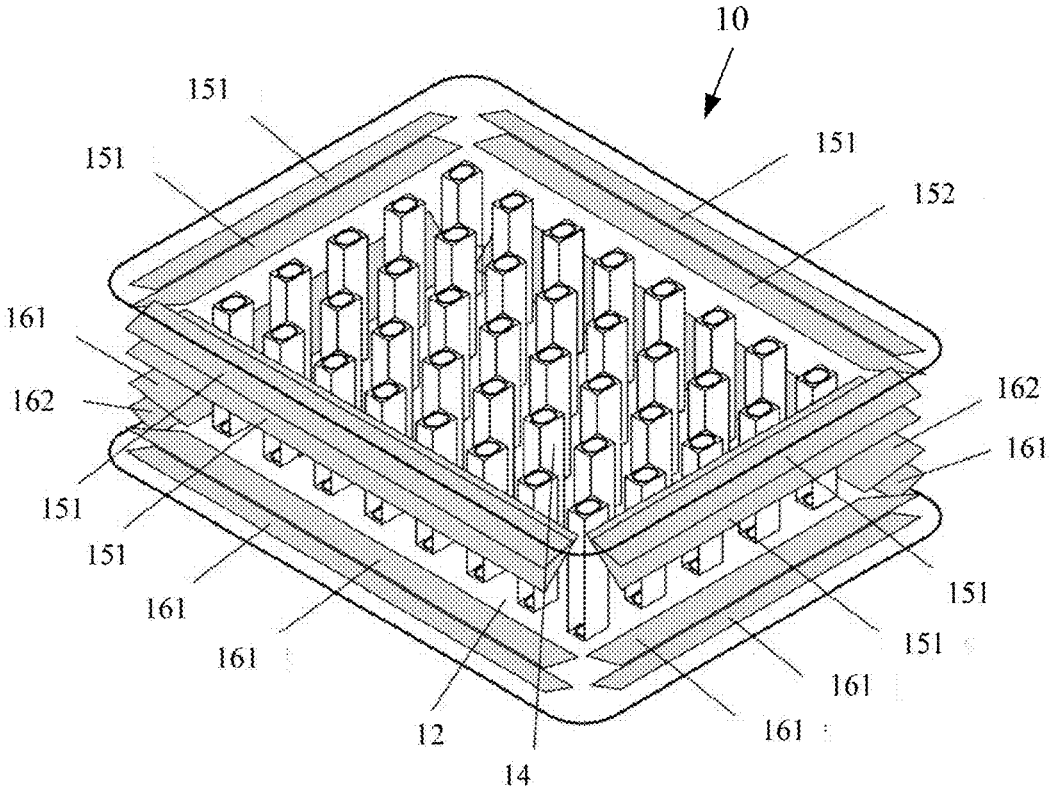
FIG. 24 is a schematic view of the interior structure of the seventh embodiment of the inflatable bed according to the present invention.

FIG. 22 is a sectional view of a seventh embodiment taken along line A-A in FIG. 4. FIG. 23 is a schematic structural partially sectional view of the seventh embodiment of the inflatable bed of the present invention. FIG. 24 is a schematic view of the interior structure of the seventh embodiment of the inflatable bed of the present invention.

As shown in FIGS. 22-24, the structure of this embodiment is substantially the same as that of the first embodiment, except that all the drawstrings in the first tensioning structure 14 employ coil beams, and the upper and lower ends of each beam of the first tensioning structure 14 are respectively coupled to the top sheet 11 and the bottom sheet 12. Several beams in the first tensioning structure 14 are arranged spaced apart from each other. After said air chamber is inflated, this structure can effectively limit the respective upward and downward bulging of the top sheet 11 and the bottom sheet 12.

According to the description of the aforementioned structures, the structural variations in the embodiments may arbitrarily combined, and are not limited to the particular embodiments described above, i.e., the number of beams contained in the second tensioning structure 15 and the number of beams contained in the third tensioning structure 16 are unlimited, which can be adjusted according to actual requirements.

Similarly, the connection between the beams in the second tensioning structure 15 and the connection between the beams in the third tensioning structure 16 are also not limited to the aforementioned embodiments, as long as the side wall 13 is divided into at least five (or equal to or greater than four) sections, for example, the number of beams in the second tensioning structure 15 and that in the third tensioning structure 16 as well as the connection thereof can be changed so as to divide the side wall 13 into multiple sections such as six or seven sections.

Of course, the structures of the first tensioning structure 14 can be commonly used in each case, and likewise serve to support the top sheet 11 and the bottom sheet 12, effectively limiting the respective upward and downward bulging of the top sheet 11 and the bottom sheet 12.

In summary, the inflatable bed of the present invention can limit the outward bulging or deformation of the side wall of the inflatable bed by using various types of tensioning structures. The structure of the inflatable bed of the present invention effectively overcomes the defect of outward bulging and deformation of the side walls of the inflatable beds and inflatable mattresses having a relatively large height in prior art, making their appearance more attractive. The inflatable beds and inflatable mattresses have a good stability, which overcomes the problem of susceptibility of rollover in the prior art. Furthermore, the inflatable bed of the present invention can also prevent the user from rolling down during use.

While the particular embodiments of the present invention have been described, a person skilled in the art should understand that these are merely illustrative, and that the scope of protection of the present invention is defined by the appended claims. Various alterations or modifications can be made by a person skilled in the art to these embodiments without departing from the principle and substance of the present invention; however, these alterations and modifications all fall within the scope of protection of the invention.

What is claimed is:

1. An inflatable bed, comprising:

a top sheet having a generally rectangular shape;

a bottom sheet having a generally rectangular shape and spaced apart from the top sheet;

a side sheet coupled to a periphery of the top sheet and a periphery of the bottom sheet to define a first side wall, a second side wall, a third side wall and a fourth side wall;

an air chamber defined by the top sheet, the bottom sheet and the side sheet;

at least one first tensioning structure located in the air chamber and coupled to the top sheet and the bottom sheet; and a second tensioning structure located in the air chamber and comprising:

a first inner upper beam coupled to the top sheet along a first inner top welding seam and coupled to the first side wall along a first inner upper side welding seam;

a second inner upper beam coupled to the top sheet along a second inner top welding seam and coupled to the second side wall along a second inner upper side welding seam;

a third inner upper beam coupled to the top sheet along a third inner top welding seam and coupled to the third side wall along a third inner upper side welding seam;

a fourth inner upper beam coupled to the top sheet along a fourth inner top welding seam and coupled to the fourth side wall along a fourth inner upper side welding seam;

a first outer upper beam coupled to the top sheet along a first outer top welding seam and coupled to the first side wall along a first outer upper side welding seam;

a second outer upper beam coupled to the top sheet along a second outer top welding seam and coupled to the second side wall along a second outer upper side welding seam;

a third outer upper beam coupled to the top sheet along a third outer top welding seam and coupled to the third side wall along a third outer upper side welding seam; and a fourth outer upper beam coupled to the top sheet along a fourth outer top welding seam and coupled to the fourth side wall along a fourth outer upper side welding seam;

wherein the first outer upper beam, the second outer upper beam, the third outer upper beam and the fourth outer upper beam are of a continuous annular structure.

2. The inflatable bed according to claim 1, wherein the first inner upper beam, the second inner upper beam, the third inner upper beam and the fourth inner upper beam are of a continuous annular structure.

3. The inflatable bed according to claim 2, wherein at least one of the first inner upper beam, the second inner upper beam, the third inner upper beam and the fourth inner upper beam further comprise an airflow passage including one or more air holes.

4. The inflatable bed according to claim 1, wherein the first inner upper beam, the second inner upper beam, the third inner upper beam and the fourth inner upper beam are of a segmental annular structure.

5. The inflatable bed according to claim 1, further comprising:

a third tensioning structure located in the air chamber and comprising:

a first inner lower beam coupled to the bottom sheet along a first inner bottom welding seam and coupled to the first side wall along a first inner lower side welding seam;

a second inner lower beam coupled to the bottom sheet along a second inner bottom welding seam and coupled to the second side wall along a second inner lower side welding seam;

a third inner lower beam coupled to the bottom sheet along a third inner bottom welding seam and coupled to the third side wall along a third inner lower side welding seam;

a fourth inner lower beam coupled to the bottom sheet along a fourth inner bottom welding seam and coupled to the fourth side wall along a fourth inner lower side welding seam;

a first outer lower beam coupled to the bottom sheet along a first outer bottom welding seam and coupled to the first side wall along a first outer lower side welding seam;

a second outer lower beam coupled to the bottom sheet along a second outer bottom welding seam and coupled to the second side wall along a second outer lower side welding seam;

a third outer lower beam coupled to the bottom sheet along a third outer bottom welding seam and coupled to the third side wall along a third outer lower side welding seam; and a fourth outer lower beam coupled to the bottom sheet along a fourth outer bottom welding seam and coupled to the fourth side wall along a fourth outer lower side welding seam.

6. The inflatable bed according to claim 5, wherein the first outer lower beam, the second outer lower beam, the third outer lower beam and the fourth outer lower beam are of a continuous annular structure.

7. The inflatable bed according to claim 6, wherein the first inner lower beam, the second inner lower beam, the third inner lower beam and the fourth inner lower beam are of a continuous annular structure.

8. The inflatable bed according to claim 7, wherein at least one of the first inner lower beam, the second inner lower beam, the third inner lower beam and the fourth inner lower beam further comprise an airflow passage including one or more air holes.

9. The inflatable bed according to claim 6, wherein the first inner lower beam, the second inner lower beam, the third inner lower beam and the fourth inner lower beam are of a segmental annular structure.

10. The inflatable bed according to claim 6, wherein at least one of the first outer lower beam, the second outer lower beam, the third outer lower beam and the fourth outer lower beam further comprise an airflow passage including one or more air holes.

11. The inflatable bed according to claim 1, wherein:

the first outer top welding seam, the second outer top welding seam, the third outer top welding seam and the fourth outer top welding seam are of one continuous seam; and the first outer upper side welding seam, the second outer upper side welding seam, the third outer upper side welding seam and the fourth outer upper side welding seam are of one continuous seam.

12. The inflatable bed according to claim 1, wherein:

the first outer top welding seam, the second outer top welding seam, the third outer top welding seam and the fourth outer top welding seam are of one continuous seam; and the first outer upper side welding seam, the second outer upper side welding seam, the third outer upper side welding seam and the fourth outer upper side welding seam are discrete.

13. The inflatable bed according to claim 1, wherein at least one of the first outer upper beam, the second outer upper beam, the third outer upper beam and the fourth outer upper beam further comprise an airflow passage including one or more air holes.

14. An inflatable bed, comprising:

a top sheet having a generally rectangular shape;

a bottom sheet having a generally rectangular shape and spaced apart from the top sheet;

a side sheet coupled to a periphery of the top sheet and a periphery of the bottom sheet to define a first side wall, a second side wall, a third side wall and a fourth side wall;

an air chamber defined by the top sheet, the bottom sheet and the side sheet;

at least one first tensioning structure located in the air chamber and coupled to the top sheet and the bottom sheet; and a second tensioning structure located in the air chamber and comprising:

a first inner upper beam coupled to the top sheet along a first inner top welding seam and coupled to the first side wall along a first inner upper side welding seam;

a second inner upper beam coupled to the top sheet along a second inner top welding seam and coupled to the second side wall along a second inner upper side welding seam;

a third inner upper beam coupled to the top sheet along a third inner top welding seam and coupled to the third side wall along a third inner upper side welding seam;

a fourth inner upper beam coupled to the top sheet along a fourth inner top welding seam and coupled to the fourth side wall along a fourth inner upper side welding seam;

a first outer upper beam coupled to the top sheet along a first outer top welding seam and coupled to the first side wall along a first outer upper side welding seam;

a second outer upper beam coupled to the top sheet along a second outer top welding seam and coupled to the second side wall along a second outer upper side welding seam;

a third outer upper beam coupled to the top sheet along a third outer top welding seam and coupled to the third side wall along a third outer upper side welding seam; and a fourth outer upper beam coupled to the top sheet along a fourth outer top welding seam and coupled to the fourth side wall along a fourth outer upper side welding seam;

wherein the first inner upper beam, the second inner upper beam, the third inner upper beam and the fourth inner upper beam are of a segmental annular structure, and the first outer upper beam, the second outer upper beam, the third outer upper beam and the fourth outer upper beam are of a continuous annular structure.

15. The inflatable bed according to claim 14, further comprising:

a third tensioning structure located in the air chamber and comprising:

a first inner lower beam coupled to the bottom sheet along a first inner bottom welding seam and coupled to the first side wall along a first inner lower side welding seam;

a second inner lower beam coupled to the bottom sheet along a second inner bottom welding seam and coupled to the second side wall along a second inner lower side welding seam;

a third inner lower beam coupled to the bottom sheet along a third inner bottom welding seam and coupled to the third side wall along a third inner lower side welding seam;

a fourth inner lower beam coupled to the bottom sheet along a fourth inner bottom welding seam and coupled to the fourth side wall along a fourth inner lower side welding seam;

a first outer lower beam coupled to the bottom sheet along a first outer bottom welding seam and coupled to the first side wall along a first outer lower side welding seam;

a second outer lower beam coupled to the bottom sheet along a second outer bottom welding seam and coupled to the second side wall along a second outer lower side welding seam;

a third outer lower beam coupled to the bottom sheet along a third outer bottom welding seam and coupled to the third side wall along a third outer lower side welding seam; and a fourth outer lower beam coupled to the bottom sheet along a fourth outer bottom welding seam and coupled to the fourth side wall along a fourth outer lower side welding seam.

16. The inflatable bed according to claim 15, wherein the first inner lower beam, the second inner lower beam, the third inner lower beam and the fourth inner lower beam are of a segmental annular structure.

17. The inflatable bed according to claim 16, wherein the first outer lower beam, the second outer lower beam, the third outer lower beam and the fourth outer lower beam are of a segmental annular structure.

18. The inflatable bed according to claim 16, wherein the first outer lower beam, the second outer lower beam, the third outer lower beam and the fourth outer lower beam are of a continuous annular structure.

19. The inflatable bed according to claim 18, wherein at least one of the first outer lower beam, the second outer lower beam, the third outer lower beam and the fourth outer lower beam further comprise an airflow passage including one or more air holes.

20. The inflatable bed according to claim 15, wherein:

the first inner lower side welding seam, the second inner lower side welding seam, the third inner lower side welding seam and the fourth inner lower side welding seam are of one continuous seam; and the first outer lower side welding seam, the second outer lower side welding seam, the third outer lower side welding seam and the fourth outer lower side welding seam are of one continuous seam.

21. The inflatable bed according to claim 14, wherein:

the first inner upper side welding seam, the second inner upper side welding seam, the third inner upper side welding seam and the fourth inner upper side welding seam are of one continuous seam; and the first outer upper side welding seam, the second outer upper side welding seam, the third outer upper side welding seam and the fourth outer upper side welding seam are of one continuous seam.

22. The inflatable bed according to claim 14, wherein at least one of the first outer upper beam, the second outer upper beam, the third outer upper beam and the fourth outer upper beam further comprise an airflow passage including one or more air holes.

* * * * *